US008015749B2

(12) United States Patent
Charrin

(10) Patent No.: US 8,015,749 B2
(45) Date of Patent: Sep. 13, 2011

(54) BOUQUET OF FLOWERS PRESENTATION DEVICE

(76) Inventor: Philippe Charrin, Beaumont-Monteux (FR)

( * ) Notice: Subject to any disclaimer, the term of this patent is extended or adjusted under 35 U.S.C. 154(b) by 301 days.

(21) Appl. No.: 11/666,449

(22) PCT Filed: Oct. 26, 2005

(86) PCT No.: PCT/EP2005/055559

§ 371 (c)(1),
(2), (4) Date: Aug. 15, 2007

(87) PCT Pub. No.: WO2006/045812

PCT Pub. Date: May 4, 2006

(65) Prior Publication Data

US 2008/0060961 A1 Mar. 13, 2008

(51) Int. Cl.
*A47G 7/02* (2006.01)

(52) U.S. Cl. ..... 47/41.01

(58) Field of Classification Search ..... 47/41.01
See application file for complete search history.

(56) References Cited

U.S. PATENT DOCUMENTS

| | | | | | |
|---|---|---|---|---|---|
| 754,248 | A * | 3/1904 | Simpson | 47/70 |
| 754,948 | A * | 3/1904 | White | 138/145 |
| 2,540,707 | A * | 2/1951 | Beukelman | 47/72 |
| 4,512,474 | A * | 4/1985 | Harding | 206/461 |
| 4,995,192 | A * | 2/1991 | DeWid | 47/30 |
| 5,099,607 | A * | 3/1992 | Lawton | 47/73 |
| 5,222,325 | A * | 6/1993 | Angus | 47/30 |
| 5,471,783 | A * | 12/1995 | McLean | 47/30 |
| 5,566,503 | A * | 10/1996 | Nickson | 47/33 |
| 5,699,913 | A * | 12/1997 | Richardson | 206/470 |
| 6,018,908 | A * | 2/2000 | Charrin et al. | 47/41.01 |
| 2004/0237389 | A1 * | 12/2004 | Whitcomb | 47/32.7 |
| 2005/0034364 | A1 * | 2/2005 | Weder | 47/41.01 |
| 2005/0150159 | A1 * | 7/2005 | Weder et al. | 47/41.01 |

* cited by examiner

*Primary Examiner* — Son T Nguyen
(74) *Attorney, Agent, or Firm* — James E. Walton; Richard G. Eldredge

(57) ABSTRACT

The invention relates to a conical device for presenting individual bouquets of flowers, said device being characterized in that it comprises a regulatable closing system consisting of complementary (3) nesting male and female three-dimensional geometrical structures, the undercut outer side of the male three-dimensional geometrical structures (6) coming into contact with the undercut inner side of the female three-dimensional geometrical structures (7).

16 Claims, 8 Drawing Sheets

Sectional view of the askew three dimensional shapes (counter draft)

BOUQUET OF FLOWERS PRESENTATION DEVICE

The invention concerns an individual bouquet of flowers presentation device according to claim 1. The dependent claims contain particular embodiments. The targeted customers is the whole florist channel (florists, horticulturist, individuals, bouqueteries, wholesalers, distributors).

The patent EP0828446 describes an individual bouquet of flowers presentation device according to the preamble of claim 1.

The individual bouquet of flowers presentation device is defined in claim 1.

The present invention will be better understood by reference to the following figures.

Figure 9:
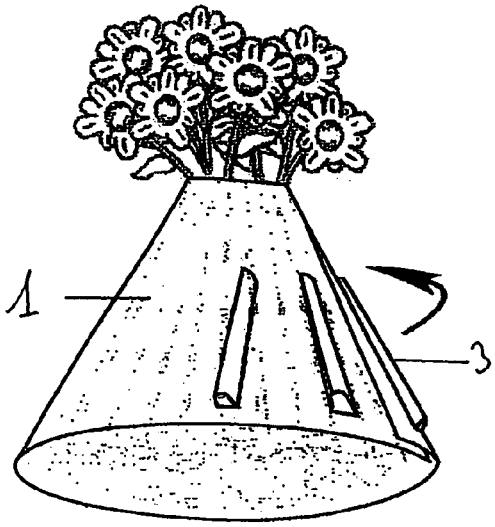

FIG. 9 represents the forming of the support of the invention in a conical volume containing a bouquet of flowers, in use position, and the adjustment system constituted by the nesting of one oblique hollow complementary male and female three-dimensional geometrical structure (in undercut), the rounds (4) within the support represent a sectional view of the flower stalks. This embodiment does not comprise the tongues.

Figure 10:
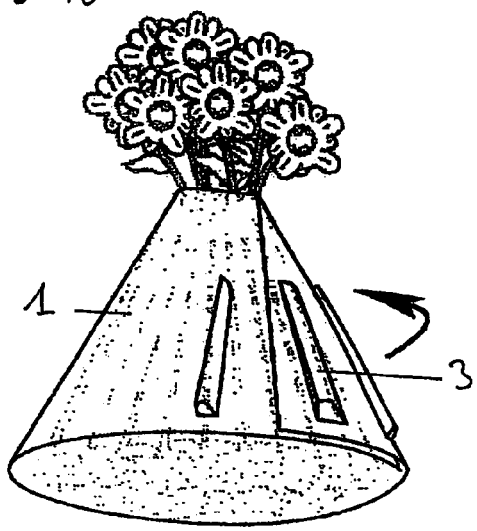

FIG. 10 represents the forming of the support of the invention in a conical volume containing a bouquet of flowers, in use position, and the adjustment system constituted by the nesting of two oblique hollow complementary male and female three-dimensional geometrical structures (in undercut), the rounds (4) within the support represent a sectional view of the flower stalks. This embodiment does not comprise the tongues.

Figure 11:
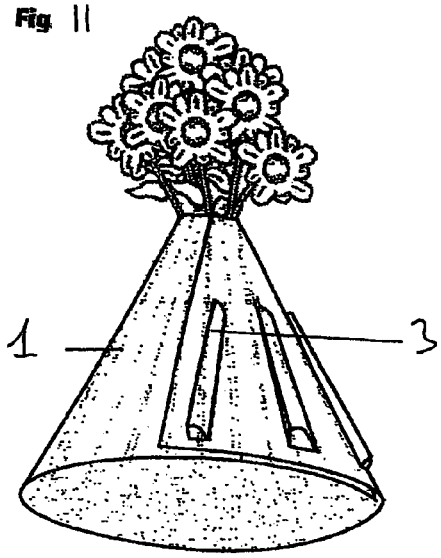

FIG. 11 represents the forming of the support of the invention in a conical volume containing a bouquet of flowers, in use position, and the adjustment system constituted by the nesting of three oblique hollow complementary male and female three-dimensional geometrical structures (in undercut), the rounds (4) within the support represent a sectional view of the flower stalks. This embodiment does not comprise the tongues.

Figure 12:
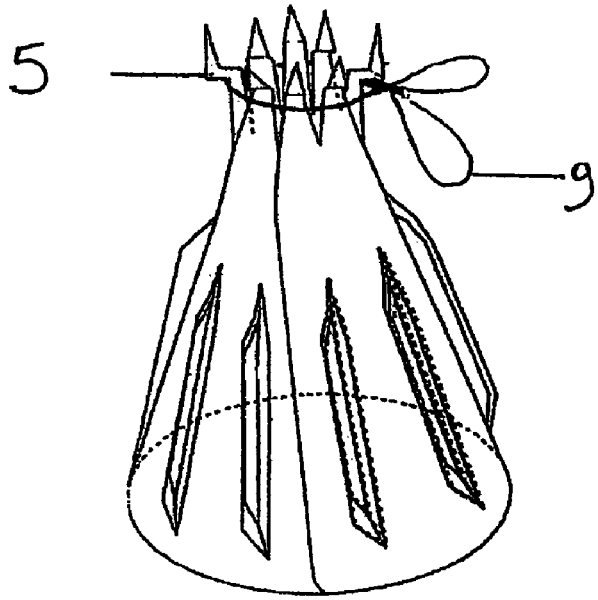

FIG. 12 represents the forming of the support of the invention in a conical volume and a retaining tooth at the level of each tongue for the possible attachment of the tie (9).

Figure 13:
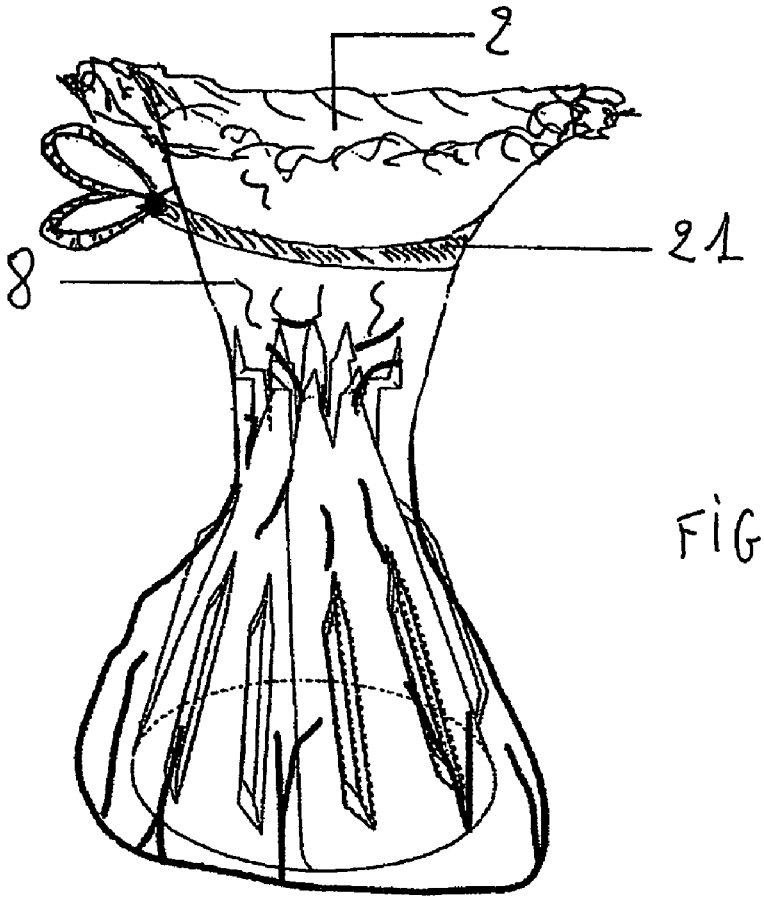

FIG. 13 represents the forming of the support of the invention in a conical volume, the retaining teeth at the level of the tongues and a water tight sheet placed under the lower edge of the lower part of the support to form a bottom and this water tight sheet is being raised along the lateral external wall of the support.

Figure 14:
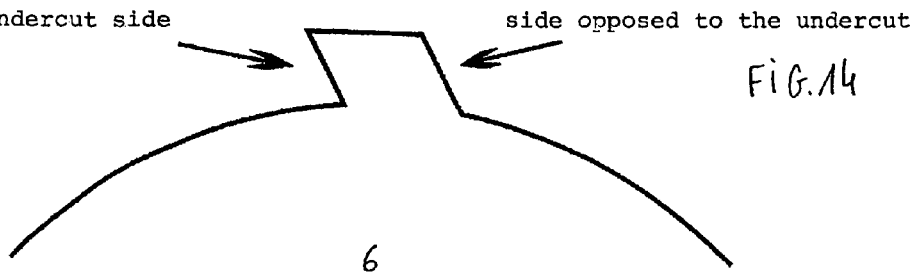

FIG. 14 represents the undercut side and the side opposed to the undercut of a male three-dimensional geometrical structure of the invention.

Figure 15:
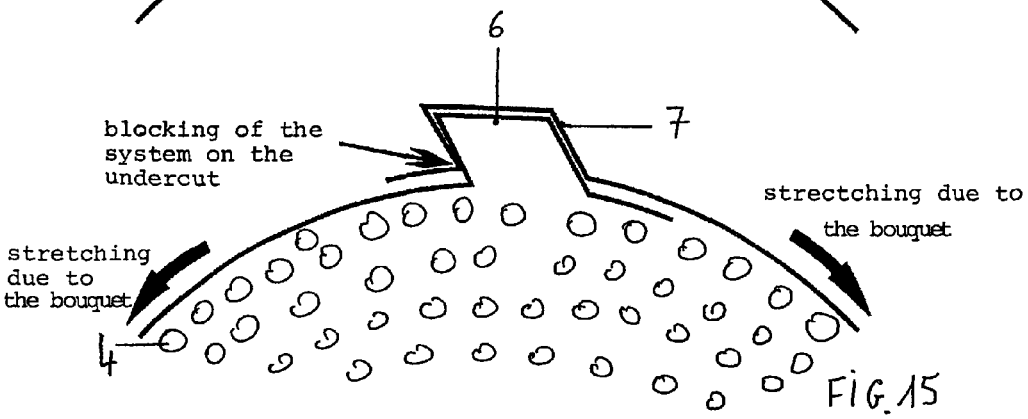

FIG. 15 represents the working mode of the male and female closing system of the present invention device, particularly the blocking of the system on the undercut side during the nesting of the male part with the female part and the opposite working stresses applied by the bouquet on the support.

Figure 16:
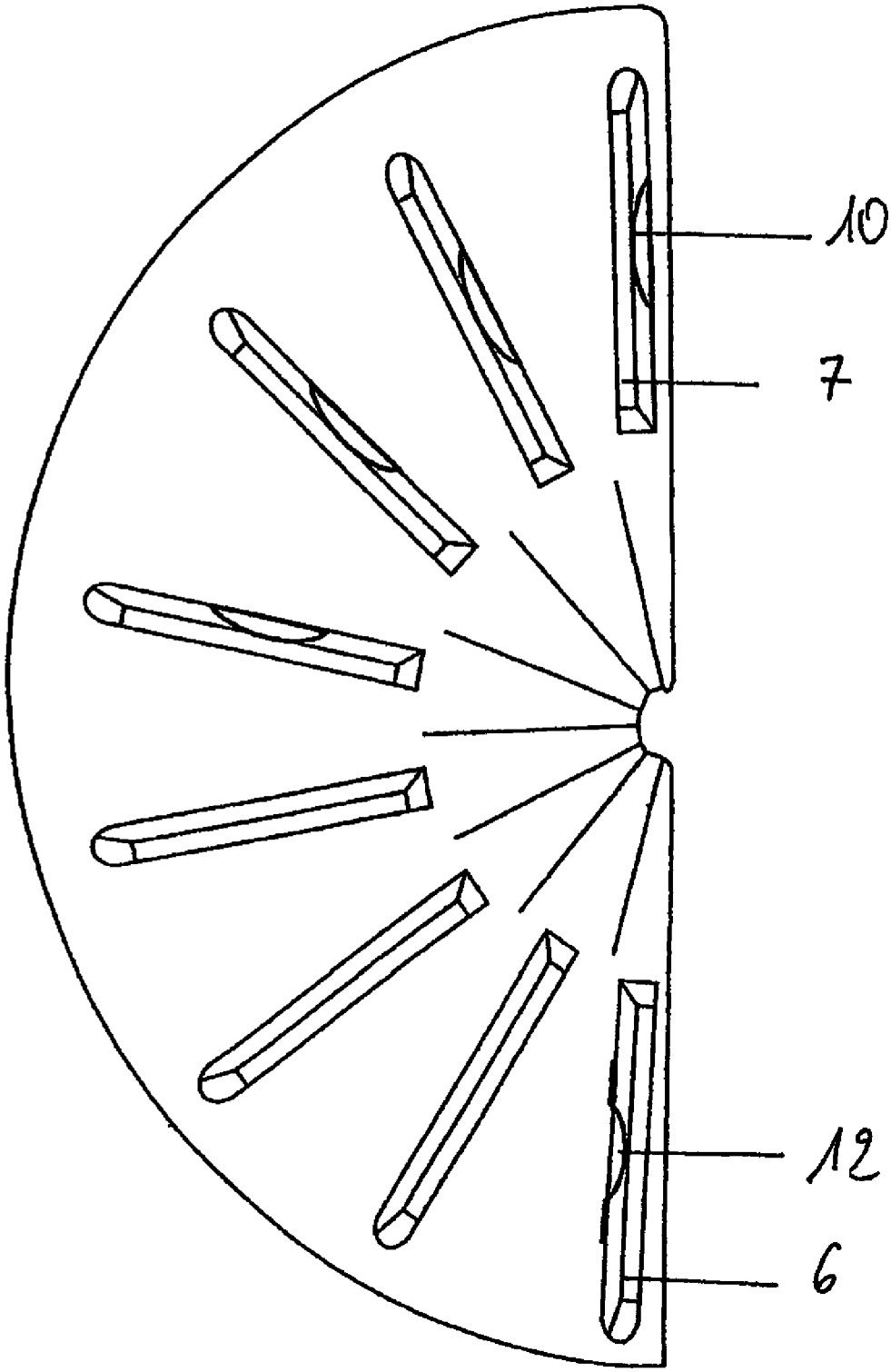

FIG. 16 represents the flat device with the female three dimensional geometrical structures (7) comprising a male locking system on its side opposed to the undercut and a female locking system on the side opposed to the undercut of a male three dimensional geometrical structure (6) complementary of the female three dimensional geometrical structure (7).

Figure 17:
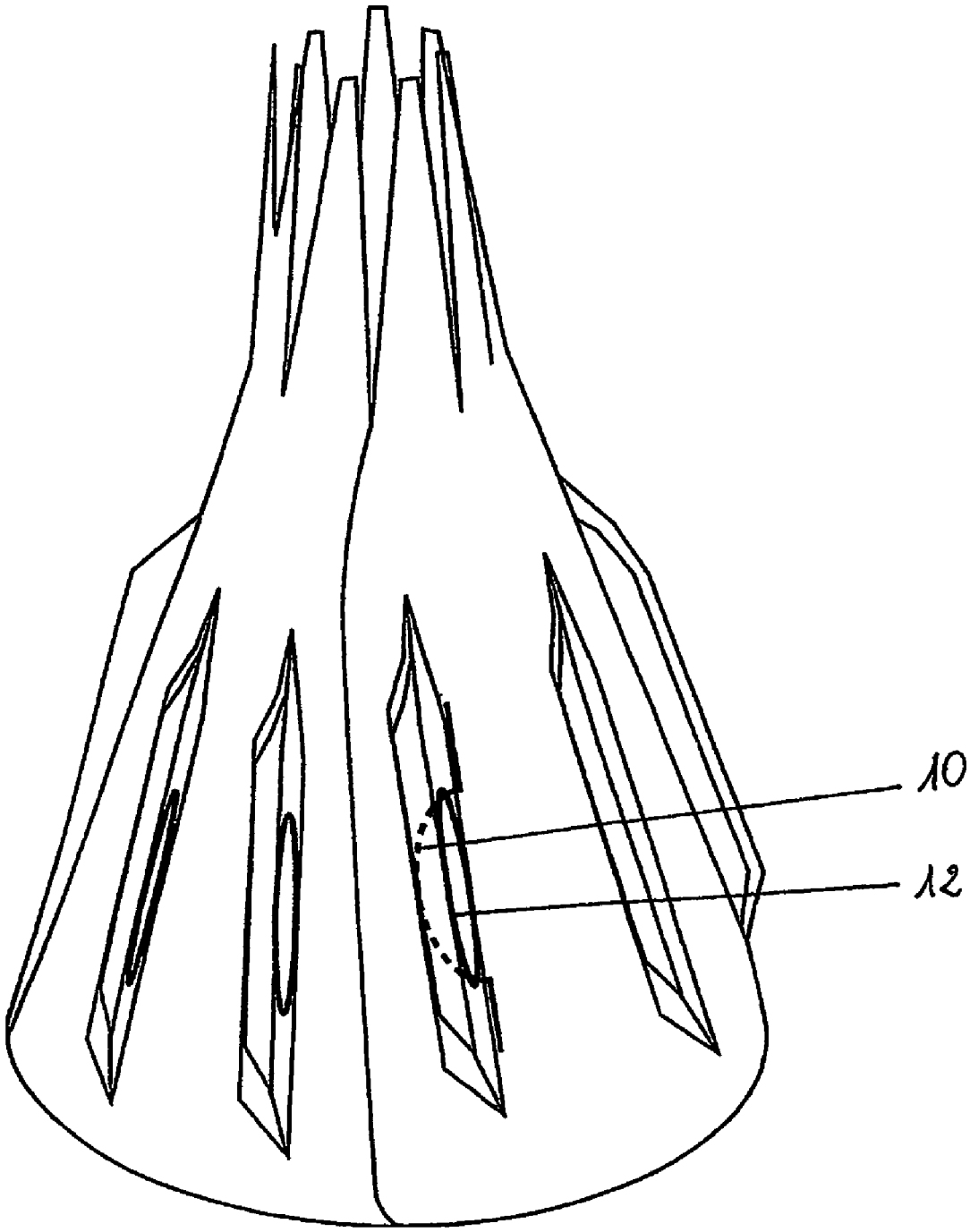

FIG. 17 represents the device in a conical volume in which one of the female three dimensional geometrical structures (7) comprises one male locking system on its side opposed to the undercut to be nested by pressure into a female blocking system on the side opposed to the undercut of a male three dimensional geometrical structure (6) complementary of the female three dimensional geometrical structure (7).

The problem solution approach is the following:

The difference between the closest state of the art i.e. EP 0828446 and the present invention is that the regulatable closing system is constituted by the nesting of male and female three dimensional geometrical structures complementary the one to the other (3), said male three dimensional geometrical structures (6) have their external side in undercut resting against the internal side in undercut of the female (7) three-dimensional geometrical structures.

The problem that the present invention proposes to solve is to improve the closing speed of the foldable support as well as the reliability of the device in order to obtain a faster locking and as effective as that of the closest prior art.

The technical effect is that the external undercut side of the male part is resting against the internal side in undercut of the female part (this is clearly shown at FIG. 15) for locking the support and thanks to the opposite working stresses applied by the bouquet on the extremities of the support (1) and particularly on the geometrical structures (3), the locking is perfect.

The solution is to nest oblique three dimensional geometrical structures with respect to the plan formed by the flat support and radial complementary the one to the other during the rolling of the support flat delivered. An adjustment of the diameter of the opening is possible by increasing or reducing the rolling of the support. The present invention inter alia is distinguished from a flower presentation device having a clipping closing system of three dimensional complementary buttons mushrooms shaped (e.g. pressure buttons) by the oblique shape (novel and inventive) of the three dimensional geometrical structures of the present invention which guarantee a blocking of the system on the undercut (this is clearly shown at FIG. 15) thanks to the opposite working stresses applied by the bouquet on the support (1) and particularly on the radial geometrical structures (3). The combination of the oblique shape of the geometrical structures and of the opposite working stresses applied by the bouquet on the undercut sides of the support has never been taught in the prior art, rendering therefore the present invention novel and inventive.

Figure 1:
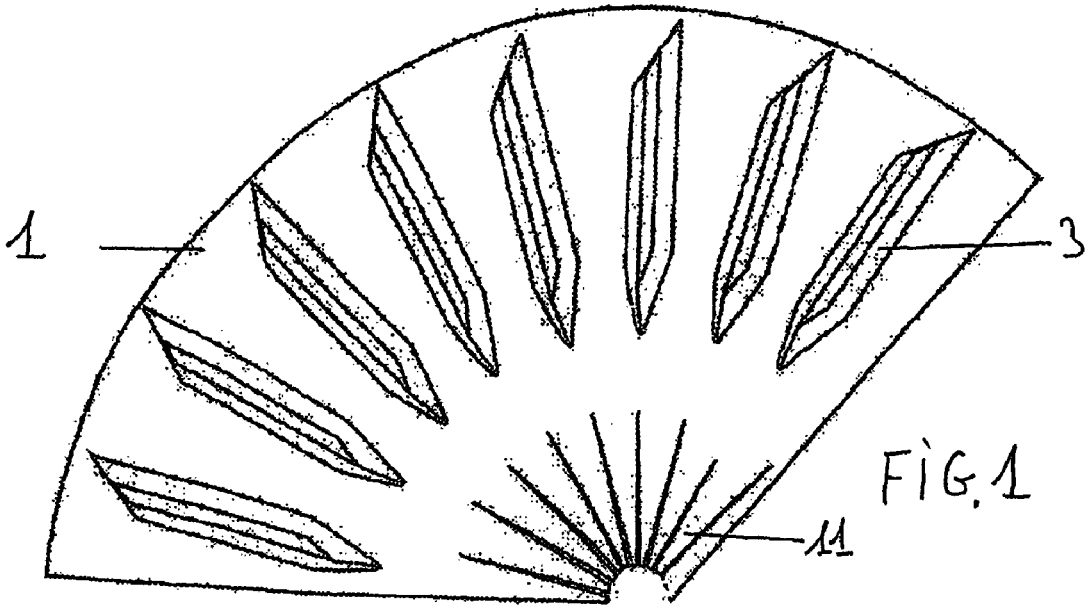
FIG. 1 represents two-third of the support surface of FIG. 3.
Figure 2:
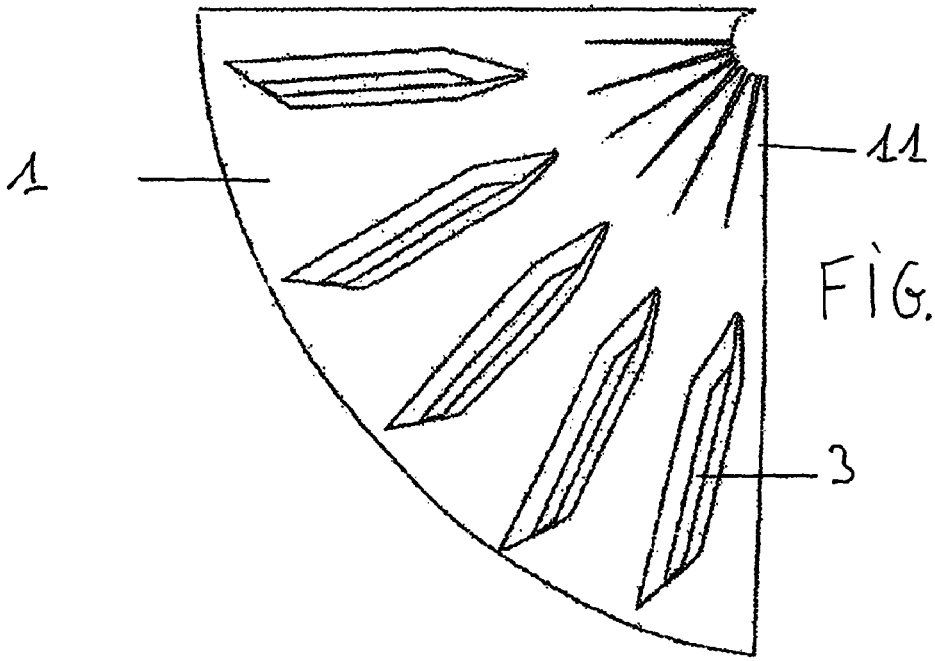
FIG. 2 represents a fraction of the support surface of FIG. 3 allowing a different forming.
Figure 3:
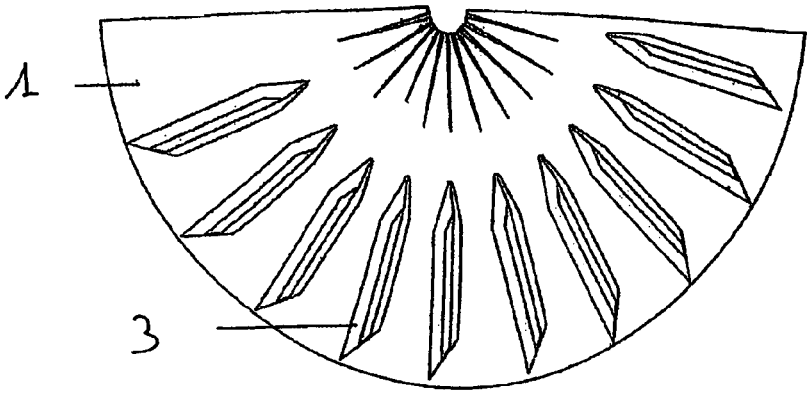
FIG. 3 represents the support of the present invention flat delivered having a plurality of hollow geometrical three-dimensional oblique structures.
Figure 4:
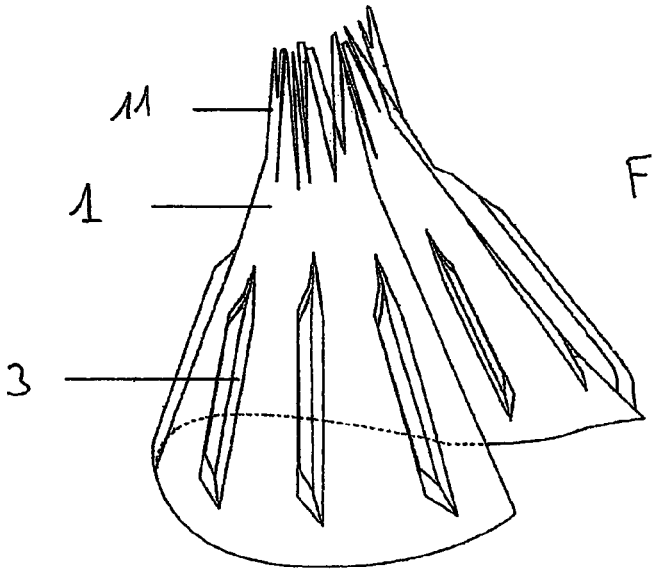
FIG. 4 represents the forming of the support of the invention in a conical volume by rolling.
Figure 5:
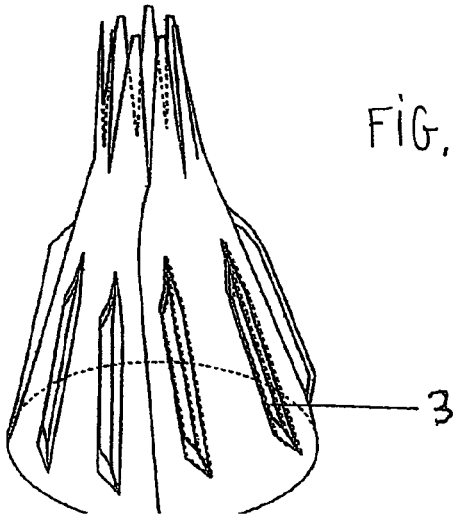
FIG. 5 represents the conical support of the invention, in use position and its adjustment system constituted by the nesting of male and female three-dimensional hollow oblique geometrical structures complementary the one to the other.

The present invention concerns a device for the vertical presentation of individual flowers bouquets with or without stock of water, more precisely a device concerning the closing of the foldable support by nesting, clipping, locking or inserting. The closing system is defined as a plurality of radial complementary female and male three dimensional geometrical structures which can be nested together, the external side in undercut of the male part is resting against internal side in undercut of the female part, the closing system of the invention is defined by a three-dimensional oblique shape of the geometrical structures (3) with respect to the plan formed by the flat support (see FIG. 3) and with a closed angle side as soon as the transformation into a conical volume is done (see FIGS. 14 and 15). The geometrical structures (3) can have any geometrical shape having at least two parallel sides (right or oblique parallelepiped, right or oblique prism, trunk of an oblique prism with parallel base, pyramid, trunk pyramid with parallel basis . . . ) without limiting to these before mentioned geometrical shapes. These geometrical structures (3) are in relief with respect to the plan formed by the flat support (1), a part of these geometrical structures have at least two parallel sides and the other part is pointed.

Figure 8:
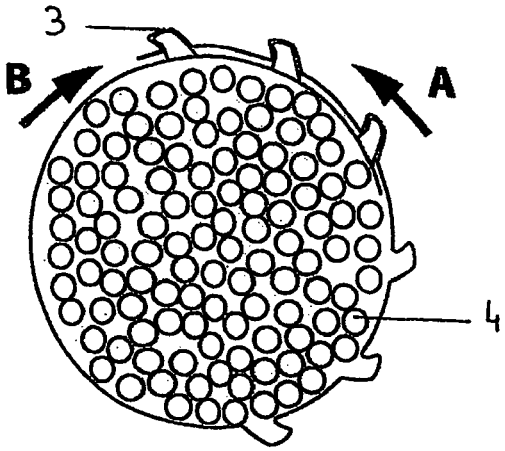
FIG. 8 represents a sectional view of the adjustment system constituted by the nesting of three oblique hollow complementary male and female three-dimensional geometrical structures (in undercut), the rounds (4) within the support represent a sectional view of the flower stalks. The arrows A and B representing the rolling direction of each extremity of the support.

The combination of the nesting of two or several undercut oblique three dimensional shapes with the working stresses applied by the bouquet on the support (1) and particularly on the oblique three dimensional shapes safeguards a perfect blocking of the system (see FIGS. 8 and 15).

Figure 6:
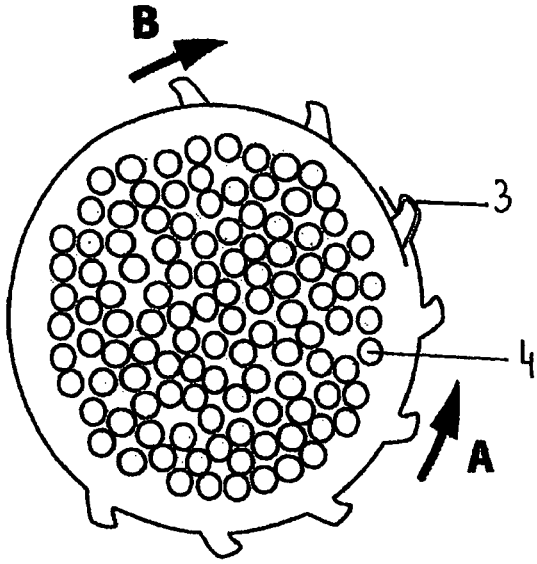
FIG. 6 represents a sectional view of the adjustment system constituted by the nesting of a oblique hollow complementary male and female three-dimensional geometrical structure (in undercut), the rounds (4) within the support represent a sectional view of the stalks. The arrows A and B representing the rolling direction of each support extremity.
Figure 7:
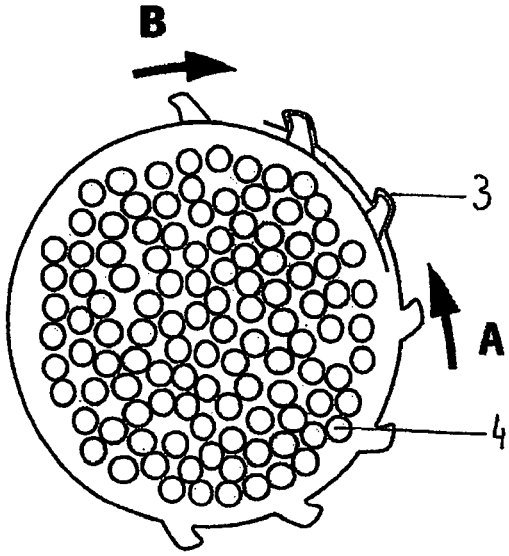
FIG. 7 represents a sectional view of the adjustment system constituted by the nesting of two oblique hollow complementary male and female three-dimensional geometrical structures (in undercut), the rounds (4) within the support represent a sectional view of the flower stalks. The arrows A and B representing the rolling direction of each extremity of the support.

The flat delivered support rolls around the bouquet and one or several geometrical structures of this support are nested together (see FIGS. 6, 7 and 8) resulting in a blocking of the support. Indeed, the tightening around the bouquet improves the closing of the system thanks to the opposed constraint forces of the undercuts (see FIG. 15: arrows) permitting a tightening and a perfect blocking of the rolled support. As a proof, the use of the support without bouquet inside provokes an insufficient maintaining during the closing of the support. The plurality of the geometrical structures gives the possibility to expand or to reduce the diameter of the variable opening adapting to the bouquet size. The device works on all support sizes and can be carried on by any means of forming (e.g. by thermoforming, molding by injection, cutting) of the clips in undercut opposed or of a pure cutting of the female side.

The present invention concerns more precisely an individual bouquet of flowers presentation device, comprising a foldable, approximatively flat, support (1) having a regulatable closing system to transform the support into a conical volume, in use position, having an upper part and lower part, this upper part can comprise a plurality of tongues (11) (facultative) and enabling a variable opening adapting to the bouquet size, a water tight sheet (8) being placed under the lower edge of this lower part of the support to form a bottom and being raised along the lateral wall of the support for making bouquets with stock of water, attachment means for maintaining the sheet (8) is a raised position along the lateral wall of the support can be foreseen to allow water to be poured via an opening (2) defined by the tongues (11) at the upper part of the foldable support (1), and said device is characterized in that the regulatable closing system is constituted by the nesting of male and female hollow oblique three-dimensional geometrical structures being complementary the one to the other (3).

The radial geometrical structures (3) function in undercut and have an elongated oblique shape and they converge to the upper part of the support (1).

An embodiment has at least one of the female three dimensional geometrical structures (7) and can comprise at least a male locking system (10) on the side opposed to the undercut of said female three dimensional geometrical structures (7) to be nested by pressure into at least one female locking system (12) on the side opposed to the undercut of at least one male (6) three-dimensional geometrical structure complementary of the female (7) three-dimensional geometrical structures.

Another embodiment has female three dimensional geometrical structures (7) which can comprise at least one male locking system on the undercut side of said female three dimensional geometrical structures (7) to be nested by pressure into at least one female locking system on the side opposed to the undercut of a male (6) three-dimensional geometrical structure complementary of the female (7) three-dimensional geometrical structures.

The water tight sheet (8) can be raised along the internal or external wall of the support (1) for the making of water stock bouquets. The support (1) can not comprise a water tight sheet if we want to maintain a dried bouquet of flowers in vertical position. However, a water tight sheet can wrap the support containing dried flowers to obtain an aesthetic decor effect. The water tight sheet is thus a facultative element. The device comprises a tie (9) rolled around the tongues for making a first attachment of the device enabling an individual and vertical presentation of the flowers. In addition, the device comprises also a ribbon (21) placed at the upper part of the support to maintain the water-tight sheet against the support (1). The ribbon (21) can be placed above the tie (9) to maintain the sheet (8) against the support (1), more particularly against the tongues.

The support can have holes for the passage of the tie (9) enabling to unite the conical support with the flower stalks.

The lower part of the support (1), in use position, constitutes an open bottom. The support (1) can in addition comprise a circular flat base element with a raised rim along its circumference like a plate for example.

The support (1) can comprise sticking means intended to maintain the sheet (8) in place before the rolling of the ribbon (21).

Each tongue can have a retaining tooth for the attachment of a tie.

The support (1) is realized by means of a plastic sheet or other materials semi-rigid or rigid and being resistant or not to water.

The water tight sheet (8) has a size that permit to this sheet (8) to contain a stock of water at the lower part of the support permitting a perfect stability of the support thanks to the weight of water. However, the support (1) can also be used without sheet (8) and thus without water, for containing a bouquet of dried flowers for example.

The invention claimed is:

1. An individual bouquet of flowers presentation device, comprising:

a foldable, approximately flat, support having an upper end, a lower end, and an external face extending from the upper end to the lower end;

an adjustable closing system carried by the support and configured for transforming the support into a volume in use position, the closing system comprising:

a male three-dimensional geometrical structure protruding from the external face of the support, the male structure having a substantially straight external undercut side and a side opposed to the undercut side; and a female three-dimensional geometrical structure protruding from the external face of the support, the female structure having a substantially straight internal side configured for abutting against the undercut side of the male structure and a side opposed to the internal side;

wherein the external undercut side is oriented at an acute angle with respect to the external face of the support;

wherein the side opposed to the undercut side is oriented at an obtuse angle with respect to the external face of the support; and wherein the undercut side hooks with the internal side of the female structure;

a female locking system, the female locking system being located on the male three-dimensional geometrical structure and positioned on the side opposed to the undercut side; and a male locking system, the male locking system being located on the female three-dimensional geometrical structure and positioned on the side opposed to the internal side, the male locking system being adapted to be nested by pressure into a female locking system;

wherein the male structure and the female structure are complementary to each other; and wherein the female structure interconnected with the male structure such that the internal side of the female structure interlocks with the external undercut side of the male structure for resisting rotational movement of the support.

2. The device according to claim 1 in which the geometrical structures are oblique.

3. The device according to claim 1 in which the geometrical structures are radial.

4. The device according to claim 1 in which the upper end comprises a plurality of tongues and permits a variable opening of the tongues accommodating to the size of the bouquet.

5. The device according to claim 4 in which the plurality of tongues have a retaining tooth for the attachment of a tie.

6. The device according to claim 1 in which a water-tight sheet is placed under a lower edge of the lower end of the support to form a bottom and is raised along a lateral wall of the support.

7. The device according to claim 6 comprising an attachment means for maintaining the sheet in a raised position along the lateral wall of the support to allow water to be poured via an opening defined by a plurality of tongues at the upper end of the foldable support.

8. The device according to claim 7 in which the attachment means comprises: a ribbon placed near the upper end of the support to maintain the water-tight sheet against the support.

9. The device according to claim 7 in which the attachment means comprises: a ribbon placed above a tie to maintain the sheet against the support.

10. The device according to claim 1 in which the foldable support can be transformed in a conical volume.

11. The device according to claim 1 in which the geometrical structures are hollow.

12. The device according to claim 1 in which the geometrical structures have an elongated shape and are pointed.

13. The device according to claim 1 in which a part of the geometrical structures have at least two parallel sides.

14. The device according to claim 1 in which the geometrical structures are in relief with respect to the plane formed by the flat support.

15. The device according to claim 1 in which a water-tight sheet is raised along an internal lateral wall of the support.

16. The device according to claim 1 in which a water-tight sheet is raised along an external lateral wall of the support.

* * * * *